US008146282B2

(12) United States Patent
Cabahug et al.

(10) Patent No.: US 8,146,282 B2
(45) Date of Patent: Apr. 3, 2012

(54) SYSTEM FOR PROVIDING ELECTRICAL POWER TO ACCESSORIES MOUNTED ON THE POWERED RAIL OF A WEAPON

(75) Inventors: Eric F. Cabahug, Fairfax, VA (US); James S. Dodd, Linden, VA (US); Ben Feldman, Reston, VA (US)

(73) Assignee: Prototype Productions, Inc., Ashburn, VA (US)

( * ) Notice: Subject to any disclaimer, the term of this patent is extended or adjusted under 35 U.S.C. 154(b) by 0 days.

(21) Appl. No.: 12/950,979

(22) Filed: Nov. 19, 2010

(65) Prior Publication Data

US 2011/0061284 A1 Mar. 17, 2011

Related U.S. Application Data

(63) Continuation-in-part of application No. 12/689,430, filed on Jan. 19, 2010, now abandoned, which is a continuation-in-part of application No. 12/689,436, filed on Jan. 19, 2010, which is a continuation-in-part of application No. 12/689,437, filed on Jan. 19, 2010, which is a continuation-in-part of application No. 12/689,438, filed on Jan. 19, 2010, which is a continuation-in-part of application No. 12/689,439, filed on Jan. 19, 2010, which is a continuation-in-part of application No. 12/689,440, filed on Jan. 19, 2010, which is a continuation-in-part of application No. 12/791,460, filed on Jun. 1, 2010.

(60) Provisional application No. 61/145,248, filed on Jan. 16, 2009, provisional application No. 61/145,216, filed on Jan. 16, 2009, provisional application No. 61/145,232, filed on Jan. 16, 2009, provisional application No. 61/145,211, filed on Jan. 16, 2009, provisional application No. 61/145,228, filed on Jan. 16, 2009, provisional application No. 61/145,222, filed on Jan. 16, 2009, provisional application No. 61/183,250, filed on Jun. 2, 2009.

(51) Int. Cl.
*F41C 23/00* (2006.01)

(52) U.S. Cl. ..... 42/85; 42/71.01; 42/72; 42/84; 42/75.03

(58) Field of Classification Search ..... 42/85, 71.01, 42/72, 84, 75.03
See application file for complete search history.

(56) References Cited

U.S. PATENT DOCUMENTS 4,533,980 A 8/1985 Hayes
(Continued)

OTHER PUBLICATIONS

In the US Patent and Trademark Office U.S. Appl. No. 12/689,430 Non-Final Office Action dated Feb. 17, 2011, 4 pages.

*Primary Examiner* — Michelle Clement
(74) *Attorney, Agent, or Firm* — Patton Boggs LLP

(57) ABSTRACT

A firearm may have a plurality of power-consuming accessories that can be attached to the weapon. In order to reduce the weight of these power-consuming accessories, as well as the proliferation of their batteries, the Weapons Accessory Power Distribution System provides a common power source to power the power-consuming accessories attached to the weapon. One or more powered rails are provided on the handguard, which encircles the barrel of the weapon, to provide a point of mechanical and electrical interconnection for the power-consuming accessories to provide quick connect mounting and dismounting of the power-consuming accessory, absent the use of connectors with their tethering cables, which are susceptible to entanglement. The powered rail(s) are electrically interconnected with a power source, which typically is a battery mounted in the butt stock of the weapon.

19 Claims, 13 Drawing Sheets

U.S. PATENT DOCUMENTS 5,033,219 A * 7/1991 Johnson et al. ..... 42/115
5,142,806 A 9/1992 Swan
5,826,363 A 10/1998 Olson
6,237,271 B1 5/2001 Kaminski
6,925,744 B2 * 8/2005 Kincel ..... 42/71.01
7,243,454 B1 * 7/2007 Cahill ..... 42/72
7,421,818 B2 9/2008 Houde-Walter
7,464,495 B2 * 12/2008 Cahill ..... 42/72
7,525,203 B1 4/2009 Racho
7,562,483 B2 * 7/2009 Hines ..... 42/90
7,584,569 B2 9/2009 Kallio et al.
7,627,975 B1 12/2009 Hines
7,640,690 B2 * 1/2010 Hines ..... 42/75.03
7,676,975 B2 * 3/2010 Phillips et al. ..... 42/72
7,712,241 B2 5/2010 Teetzel et al.
7,818,910 B2 * 10/2010 Young ..... 42/71.01
7,841,120 B2 11/2010 Teetzel et al.
7,866,083 B2 1/2011 Teetzel
7,975,419 B2 * 7/2011 Darian ..... 42/84
2005/0241206 A1 11/2005 Teetzel et al.
2008/0040965 A1 2/2008 Solinsky et al.
2008/0170838 A1 * 7/2008 Teetzel et al. ..... 386/118
2008/0190002 A1 * 8/2008 Hines ..... 42/1.06
2009/0044439 A1 * 2/2009 Phillips et al. ..... 42/72
2009/0108589 A1 * 4/2009 Racho ..... 290/1 R
2009/0255160 A1 * 10/2009 Summers ..... 42/70.01
2010/0031552 A1 2/2010 Houde-Walter
2010/0083553 A1 4/2010 Montgomery
2010/0192446 A1 8/2010 Darian
2010/0192448 A1 8/2010 Darian
2010/0242332 A1 9/2010 Teetzel et al.
2011/0000120 A1 1/2011 Thompson
2011/0010979 A1 1/2011 Houde-Walter
2011/0162251 A1 * 7/2011 Houde-Walter ..... 42/146

* cited by examiner

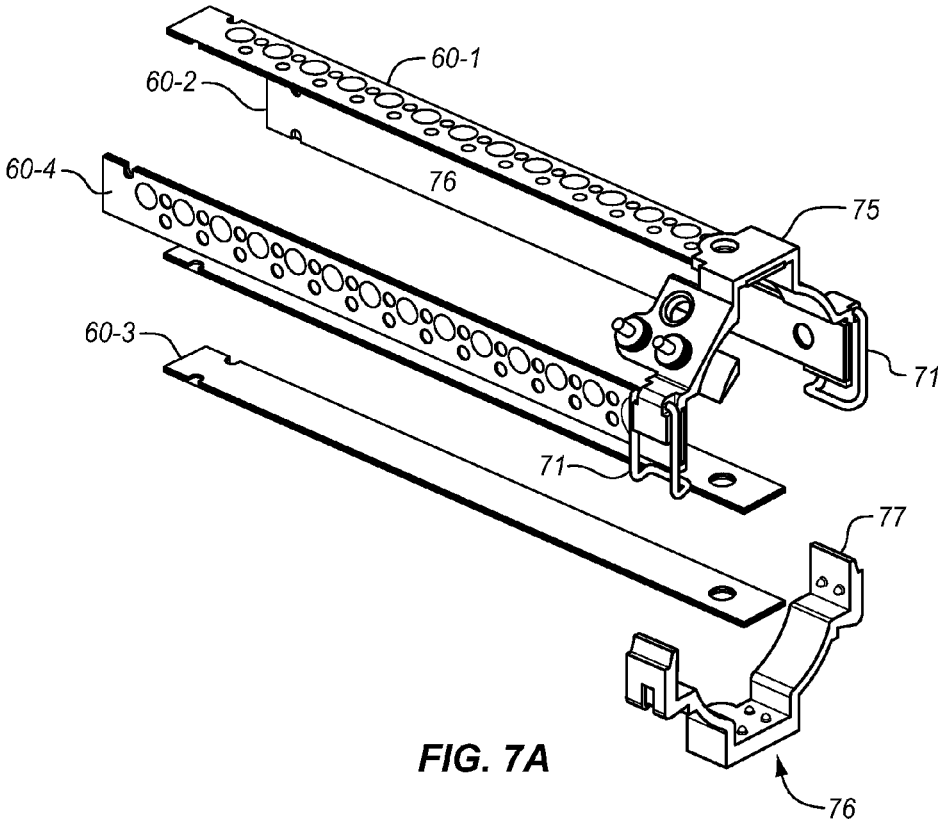
FIG. 7A
FIG. 7B
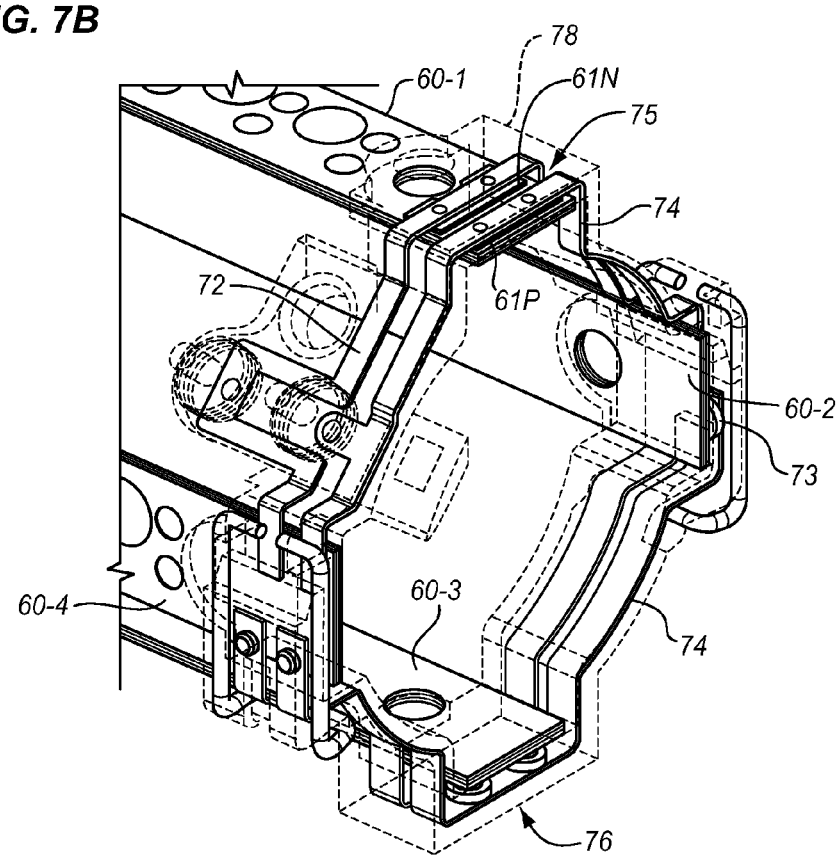

SYSTEM FOR PROVIDING ELECTRICAL POWER TO ACCESSORIES MOUNTED ON THE POWERED RAIL OF A WEAPON

CROSS-REFERENCE TO RELATED APPLICATIONS

This application is a continuation-in-part of U.S. patent application Ser. No. 12/791,460 filed on Jun. 1, 2010 titled "Rugged Low Light Reflectivity Electrical Contact", which claims the benefit of U.S. Provisional Patent Application Ser. No. 61/183,250 filed on Jun. 2, 2009 entitled "Non-Reflective, Conductive Mesh, Environmentally Robust Electrical Contacts." This application is also a continuation-in-part of U.S. patent application Ser. No. 12/689,439 filed on Jan. 19, 2010 titled "Rifle Accessory Rail Communication And Power Transfer System-Power Distribution", which claims the benefit of U.S. Provisional Patent Application Ser. No. 61/145,228 filed on Jan. 16, 2009; U.S. patent application Ser. No. 12/689,430 filed on Jan. 19, 2010 titled "Rifle Accessory Rail, Communication, And Power Transfer System", which claims the benefit of U.S. Provisional Patent Application Ser. No. 61/145,248 filed on Jan. 16, 2009; U.S. patent application Ser. No. 12/689,436 filed on Jan. 19, 2010 titled "Accessory Mount For Rifle Accessory Rail Communication And Power Transfer System-Accessory Attachment", which claims the benefit of U.S. Provisional Patent Application Ser. No. 61/145,216 filed on Jan. 16, 2009; U.S. patent application Ser. No. 12/689,437 filed on Jan. 19, 2010 titled "Rifle Accessory Rail Communication And Power Transfer System-Communication", which claims the benefit of U.S. Provisional Patent Application Ser. No. 61/145,232 filed on Jan. 16, 2009; U.S. patent application Ser. No. 12/689,438 filed on Jan. 19, 2010 titled "Rifle Accessory Rail Communication And Power Transfer System-Battery Pack", which claims the benefit of U.S. Provisional Patent Application Ser. No. 61/145,211 filed on Jan. 16, 2009; and U.S. patent application Ser. No. 12/689,440 filed on Jan. 19, 2010 titled "Rifle Accessory Rail Communication And Power Transfer System-Rail Contacts", which claims the benefit of U.S. Provisional Patent Application Ser. No. 61/145,222 filed on Jan. 16, 2009. The foregoing applications are hereby incorporated by reference to the same extent as though fully disclosed herein.

STATEMENT REGARDING FEDERALLY SPONSORED RESEARCH OR DEVELOPMENT

This application is sponsored by the US Department of Defense under Contract Numbers W15QKN-08-C-0072 and W15QKN-09-C-0045.

FIELD OF THE INVENTION

The invention relates generally to the field of electrical power distribution and, more particularly, to an electrical power distribution system for use with a powered rail of a weapon to provide electric power to power-consuming accessories mounted on the powered rail.

BACKGROUND OF THE INVENTION

It is a problem to reliably provide electric power to power-consuming accessories which are mounted on a weapon in an environmentally hostile environment. The typical adverse natural environment includes, but is not limited to, corrosion, chemical contamination, extreme temperatures, humidity, rain, dirt, ice, and abrasion. The traditional approach is to have each power-consuming accessory completely self-contained, each with its own batteries. However, the weight of the batteries in all of the power-consuming accessories creates an imbalance in the weapon and adds a significant amount of weight to the weapon. That, coupled with the cost of provisioning numerous types of batteries renders self-contained accessories a poor choice. Therefore, the provision of a common power source is a preferred solution. The Powered Rail must have a method of electrically connecting the power-consuming accessory to a common power source which is operationally associated with the weapon.

There are two modes of electrically interconnecting two or more circuit elements together. One mode of electrical interconnection is to hardwire the circuit elements together, which renders the resultant apparatus a unitary structure. The second mode of electrical interconnection is to use one or more electrical contacts to interconnect the circuit elements, thereby enabling the circuit elements to be removably attached to each other and/or to a power source. The electrical contacts are either mounted on mating surfaces of two elements, coming into contact when the two elements are juxtaposed to each other and mechanically forced together, or mounted in connectors, which are electrically tethered to the respective elements via cables, and joined together via locking connector shells which house the respective set of mating electrical contacts and protect the respective sets of contacts from the ambient environment.

The use of electrical contacts mounted on mating surfaces of two elements is optimal for quick connect applications, but these contacts are susceptible to contamination, which degrades performance. The exposed contacts, therefore, must be manufactured from a material that provides low resistivity (such as gold) even when exposed to the hostile ambient environment.

To protect electrical contacts from hostile ambient environmental conditions, such as outdoor applications, the electrical contacts typically are housed in a weatherproof housing, such as a connector shell or a weatherproof sealed box. However, the tethering electrical cable and the connector shell are significantly more expensive than the use of electrical contacts mounted on mating surfaces of two elements, although they provide greater protection from the environment, but are also less convenient for quick connect applications.

Thus, there is presently no power-consuming accessory interconnection system that can be used in a quick connect application on a weapon, which operates in a reliable manner in a hostile ambient environment, is inexpensive, and is long lived.

BRIEF SUMMARY OF THE INVENTION

The above-described problems are solved and a technical advance achieved by the present System For Providing Electrical Power To Accessories Mounted On The Powered Rail Of A Weapon (termed "Weapons Accessory Power Distribution System" herein) which is adapted for use in weapons, such as military weapons. A firearm used in military applications may have a plurality of accessories that can be attached to the weapon, with each accessory having a need for electric power. In order to reduce the weight of these power-consuming accessories, as well as the proliferation of batteries used to power these power-consuming accessories, a common power source is used to power whatever power-consuming accessory is attached to the weapon. One or more powered rails are provided on the handguard, which encircles the barrel of the weapon, to provide a point of mechanical and electrical interconnection for the power-consuming accessories to provide quick connect mounting and dismounting of the power-consuming accessory, absent the use of connectors with their tethering cables, which are susceptible to entanglement. The powered rail(s) are electrically interconnected with a power source, which typically is a battery mounted in the butt stock of the weapon. The power transfer between the power source and the powered rail uses a permanent power distribution system mounted on the weapon, although a pistol grip mounted power source, or a powered rail mounted power source, or an external power source electrically connected to the powered rail are alternatives.

The Weapons Accessory Power Distribution System is designed for use in an unprotected manner where the components are exposed to harsh ambient environmental conditions. The Weapons Accessory Power Distribution System provides the following benefits:

Use of a single compact power source,

Significant reduction in the weight of the accessory/power source system,

By moving mass rearward, the time to bring the weapon to point is reduced, as well as the time needed to "stop" the muzzle when the target is acquired, Compatibility with the existing Picatinny Rail for mounting accessories, Performance reliability, and Inexpensive to manufacture.

The primary components of this Weapons Accessory Power Distribution System, which is used as an application example, are:

Battery Pack,

Power Distribution System,

Handguard (optional),

Powered Rail, and

Power-Consuming Accessory Mounting.

The following description provides a disclosure of the Weapons Accessory Power Distribution System in sufficient detail to understand the teachings and benefits of the Weapons Accessory Power Distribution System, which is delimited by the appended claims.

BRIEF DESCRIPTION OF THE DRAWINGS

FIGS. 6A and 6B are plan and perspective views, respectively, of two implementations of the Powered Rail, while

FIGS. 7A and 7B illustrate the details of the Powered Rail electrical interconnection;

DETAILED DESCRIPTION OF THE PREFERRED EMBODIMENT

Definitions

Contact—One-half of a Contact Pair consisting of an electrically conductive surface which is electrically connected to a power source or power-consuming device.

Contact Pair—A set of two Contacts which, when brought together in mechanical contact, complete an electrical circuit enabling the transfer of electrical power and/or electrical signals therebetween.

Visible Spectrum—The visible spectrum is the portion of the electromagnetic spectrum that is visible to (can be detected by) the human eye. Electromagnetic radiation in this range of wavelengths is called "visible light" or simply "light". A typical human eye responds to wavelengths from about 390 nm to 750 nm. In terms of frequency, this corresponds to a band in the vicinity of 400 THz to 790 THz.

Electrical Resistivity—Electrical Resistivity is a measure of how strongly a material opposes the flow of electric current. A low resistivity indicates a material that readily allows the movement of electrical charge.

Electrical Conductivity—Electrical Conductivity (the inverse of Electrical Resistivity) is a measure of how strongly a material supports the flow of electric current. A high conductivity indicates a material that readily allows the movement of electrical charge.

Picatinny Rail

It is well known to those skilled in the art that rapid fire firearms, utilized particularly in military operations, are characterized by the heating of the barrel of the weapon to relatively high temperatures. At such temperatures, the barrel cannot be safely held by the person firing the weapon. Consequently, a variety of handguards have been developed to shroud the barrel of such rapid fire weapons to enable the person firing the weapon to grip the forward portion of the weapon while mitigating the possibility of burning the hand of the person firing the weapon, yet also providing adequate cooling for the barrel of the weapon.

Figure 1A:
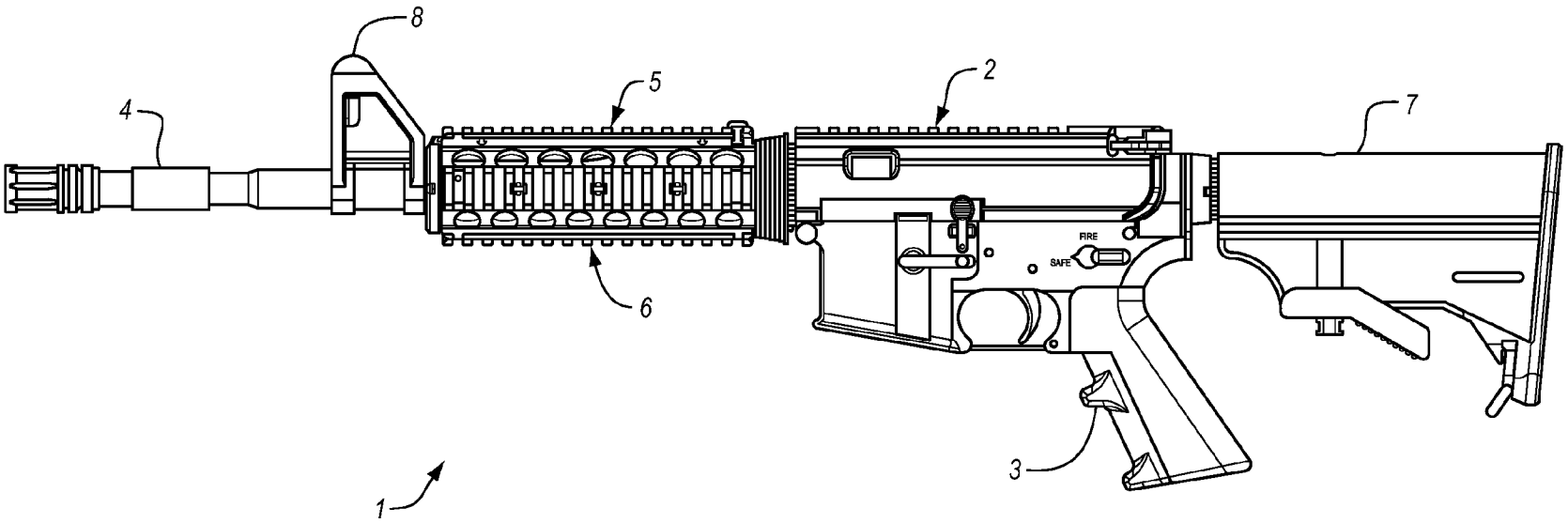
FIG. 1A PRIOR ART
FIGS. 1A-1C are illustrations of the prior art Picatinny Rail mounted on a military style weapon, which is used to mount accessories to the weapon as is well known in the art.
Figure 1B:
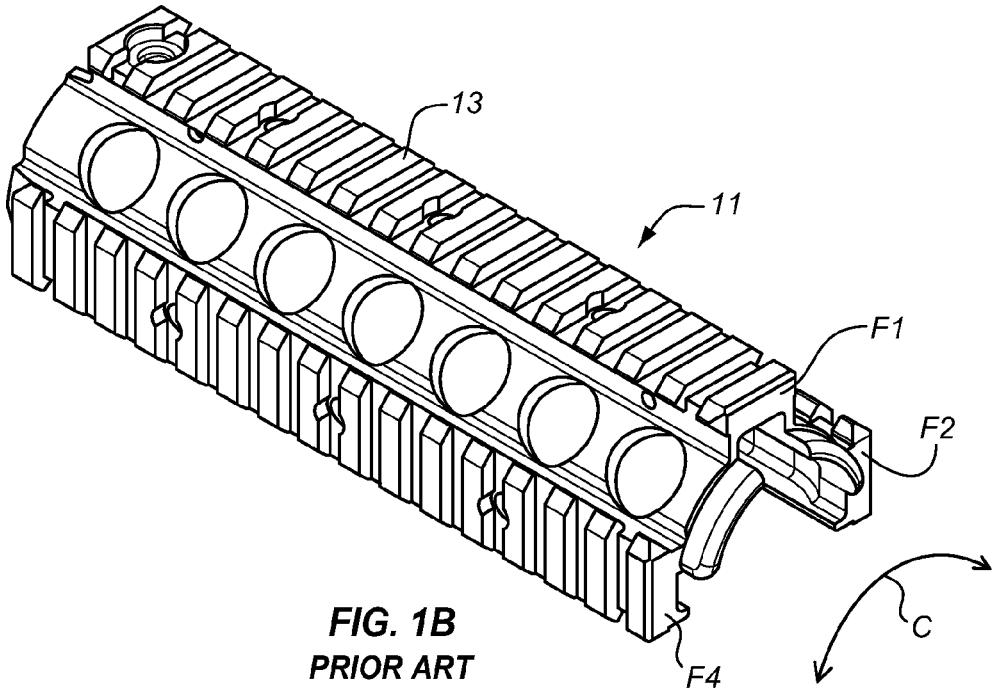
FIG. 1B PRIOR ART
Figure 1C:
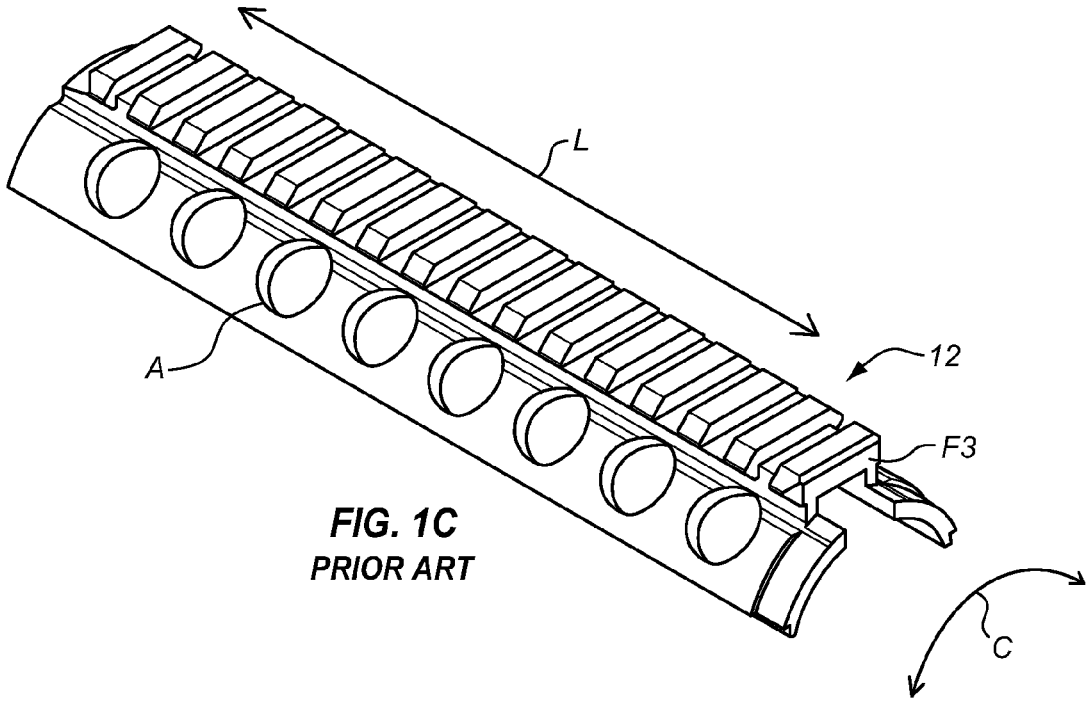
FIG. 1C PRIOR ART

FIGS. 1A-1C are illustrations of the prior art Picatinny Rail mounted on a military style weapon 1, which is used to mount accessories to the weapon as is well known in the art. The weapon 1 contains the standard components, such as receiver 2, grip 3, barrel 4, handguard 5, 6, butt stock 7, and front sight 8. The Picatinny Rail or MIL-STD-1913 rail (and NATO equivalent—STANAG 4694) is a bracket used on some firearms to provide a standardized accessory mounting platform. Its name comes from the Picatinny Arsenal in New Jersey, USA where it was originally tested and was used to distinguish it from other rail standards at the time. The Picatinny Rail comprises a series of ridges with a T-shaped cross-section interspersed with flat "locking slots" (also termed "recoil groove"). Scopes are mounted either by sliding them on from one end of the Picatinny Rail or the other end of the Picatinny Rail by means of a "rail-grabber", which is clamped to the Picatinny Rail with bolts, thumbscrews, or levers, or onto the slots between the raised sections. Scopes and other accessories also can be (and usually are) mounted from the sides of the rail, not just slid over the ends.

With particular reference to FIGS. 1A-1C, the Picatinny Rail is shown as integrated into handguard 5, 6, which includes a top semi-cylindrical (C) part 11 and a bottom semi-cylindrical (C) part 12. The top semi-cylindrical part 11 is defined by a back end having a back end ledge that engages with a slip ring and a front end having a front end ledge that engages with the receptor cap to retain the part 11 about the barrel 4. Similarly, the bottom part 12 is defined by a back end having a back end ledge that engages with the slip ring and a front end having a front end ledge that engages with the receptor cap to retain the part 12 about the barrel 4. An accessory adapter rail 13 extends longitudinally and upwardly from the top semi-cylindrical part 11. The handguard 5, 6 may also include accessory adapter side rails and accessory adapter bottom rails. Thus, the Picatinny Rail is formed of a multi-faceted (F1-F4) structure, on each facet of which accessories can be mounted. Apertures A are provided along the length dimension L of the Picatinny Rail to enable the barrel 4 of the weapon 1 to be cooled by air circulation from the ambient environment.

The Picatinny Rail was originally designed for use with scopes. However, once established, the use of the Picatinny Rail was expanded to other accessories, such as tactical lights, laser aiming modules, night vision devices, reflex sights, fore grips, bipods, and bayonets. Because the Picatinny Rail was originally designed and used for telescopic sights, the rails were first used only on the receivers of larger caliber rifles. However, their use has extended to the point that Picatinny Rails and accessories have replaced iron sights in the design of many firearms, and they are also incorporated into the undersides of semi-automatic pistol frames and even on grips.

In order to provide a stable platform, the rail should not flex as the barrel heats and cools; this is the purpose of the locking slots: they give the rail considerable room to expand and contract lengthwise without distorting its shape.

Powering the multitude of accessories used on weapons equipped with the Picatinny Rail has been accomplished by equipping each accessory with its own set of batteries. A significant problem with this paradigm is that multiple types of batteries are used for accessories, thereby requiring an extensive inventory of replacements. In addition, the batteries, especially on high power accessories, add significant weight to the barrel end of the weapon, adding strain to the user of the weapon to hold the barrel "on target" in an "off-hand manner" without support for the barrel.

Reticle Illumination

One example of an accessory for a weapon is a scope which includes a reticle which can be illuminated for use in low light or daytime conditions. The reticle is a grid of fine lines in the focus of the scope, used for determining the position of the target. With any illuminated low light reticle, it is essential that its brightness can be adjusted. A reticle that is too bright causes glare in the operator's eye, interfering with his ability to see in low light conditions. This is because the pupil of the human eye closes quickly upon receiving any source of light. Most illuminated reticles provide adjustable brightness settings to adjust the reticle precisely to the ambient light. Illumination is usually provided by a battery powered LED, though other electric light sources can be used. The light is projected forward through the scope, and reflects off the back surface of the reticle. Red is the most common color used, as it least impedes the shooter's night vision. This illumination method can be used to provide both daytime and low light conditions reticle illumination.

Other examples of powered accessories include, but are not limited to: tactical lights, laser aiming modules, and night vision devices.

Weapon Equipped with Weapons Accessory Power Distribution System

Figure 2A:
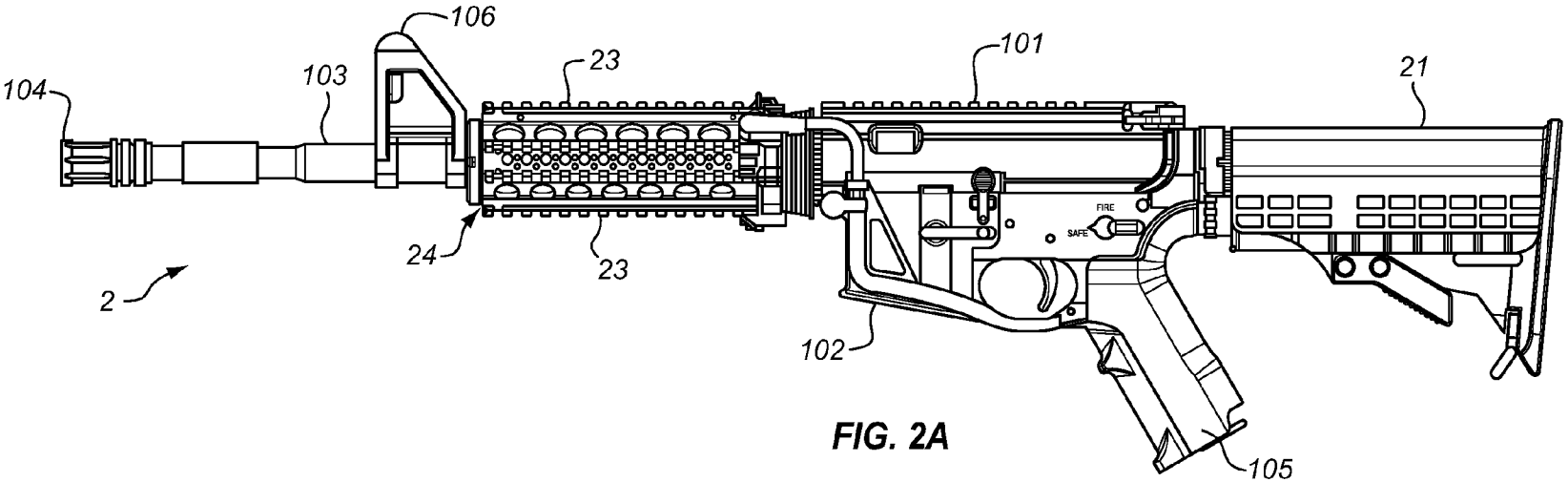
FIGS. 2A and 2B are illustrations of the system architecture of a military style weapon equipped with a Weapons Accessory Power Distribution System.
Figure 2B:
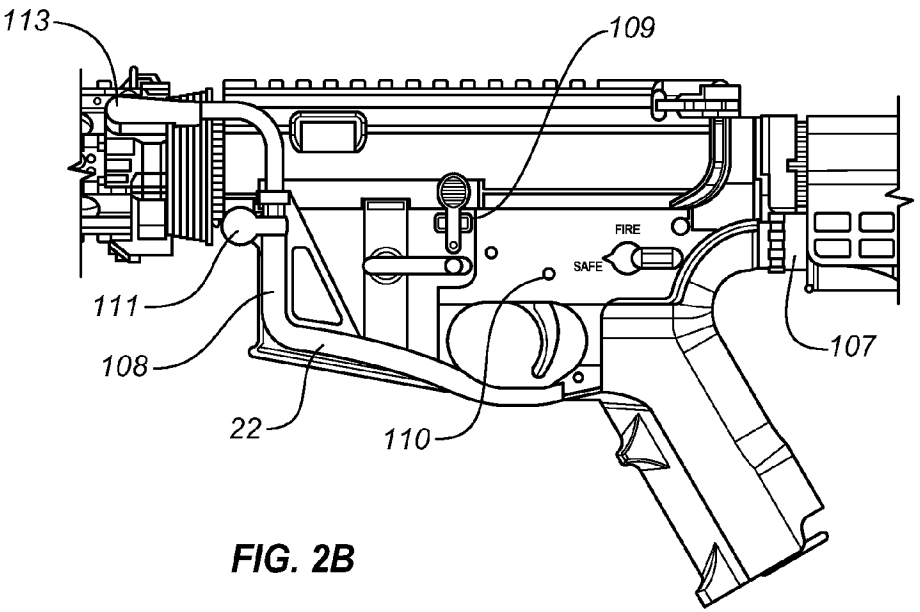
Figure 3A:
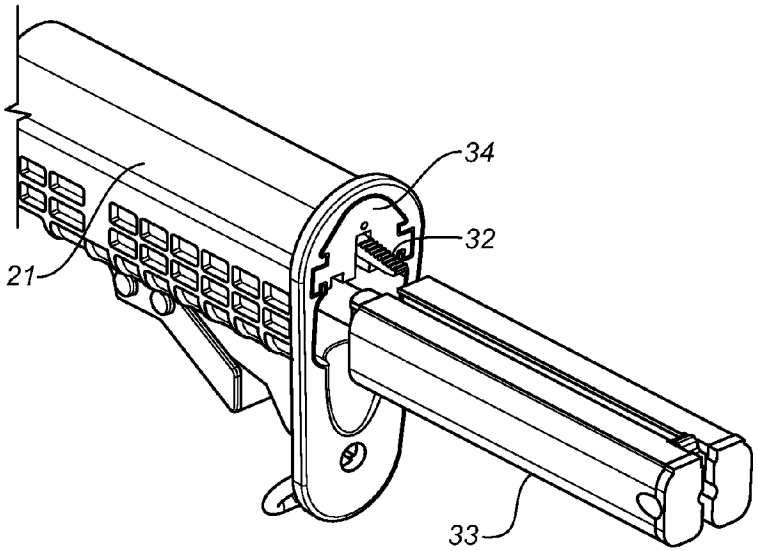
FIGS. 3A and 3B are illustrations of a typical butt stock battery pack of the Weapons Accessory Power Distribution System.

FIGS. 2A and 2B are illustrations of the system architecture of a military style weapon 2 equipped with a Weapons Accessory Power Distribution System. The primary components of the basic Weapons Accessory Power Distribution System as noted above are:

Butt Stock 21 with Battery Pack 33 (shown in FIG. 3A);
Power Distribution System 22;
Handguard 23 (optional);
Powered Rail 24; and
Powered Accessory Mounting 25 (shown in FIG. 8A).

The existing military-style weapon 2 includes in well-known fashion an upper receiver 101, lower receiver 102, barrel 103, muzzle 104, grip 105, and front sight 106. While a military-style weapon is described herein, the teachings of this application are equally applicable to other firearms, such as handguns, fixed mount machine guns, as well as non-weapons based systems. The Weapons Accessory Power Distribution System is added to this standard military-style weapon 2 as described herein.

The Handguard 23 performs the barrel shielding function as in the Picatinny Rail noted above, but has been modified, as shown in FIGS. 2A and 2B, to accommodate the Powered Rail 24 and electrical interconnection of the Powered Accessory Mounting 25 to the Powered Rail 24, as described below. In particular, a combination of Powered Rails 24 and Handguard sections 23 are attached together to form a structure which typically encircles the barrel 103. The Powered Rails 24 in effect form facets around the periphery of the resultant Handguard structure. Thus, herein the term "Handguard" is used to represent the sections of a handguard structure as well as the well-known combination of Handguard sections and Powered Rails which encircle the barrel 103 as shown in FIGS. 2A and 2B. As alternative structures, the Powered Rail 24 can be attached to a Handguard 23 that encircles the barrel. Furthermore, there is no requirement to use the Handguard 23 as an integral component of the Weapons Accessory Power Distribution System, so the Handguard 23 can be optional, with the Powered Rail(s) 24 being attached to the weapon in some other manner, such as an upper receiver rail 101 in FIG. 2A. For the purpose of illustrating the Weapons Accessory Power Distribution System, the first of the above-listed configurations is used herein.

Handguard

As noted above, the Handguard 23 was developed to shroud the barrel 103 of a rapid fire weapon 2 to enable the person firing the weapon 2 to grip the forward portion of the weapon 2 while mitigating the possibility of burning the hand of the person firing the weapon 2, yet also providing adequate cooling for the barrel 103 of the weapon. Handguards find application in rifles, carbines, and fixed mount weapons, such as machine guns. However, the Weapons Accessory Power Distribution System can also be used in modified form for handguns, as an accessory mounting platform and accessory power source.

Figure 5A:
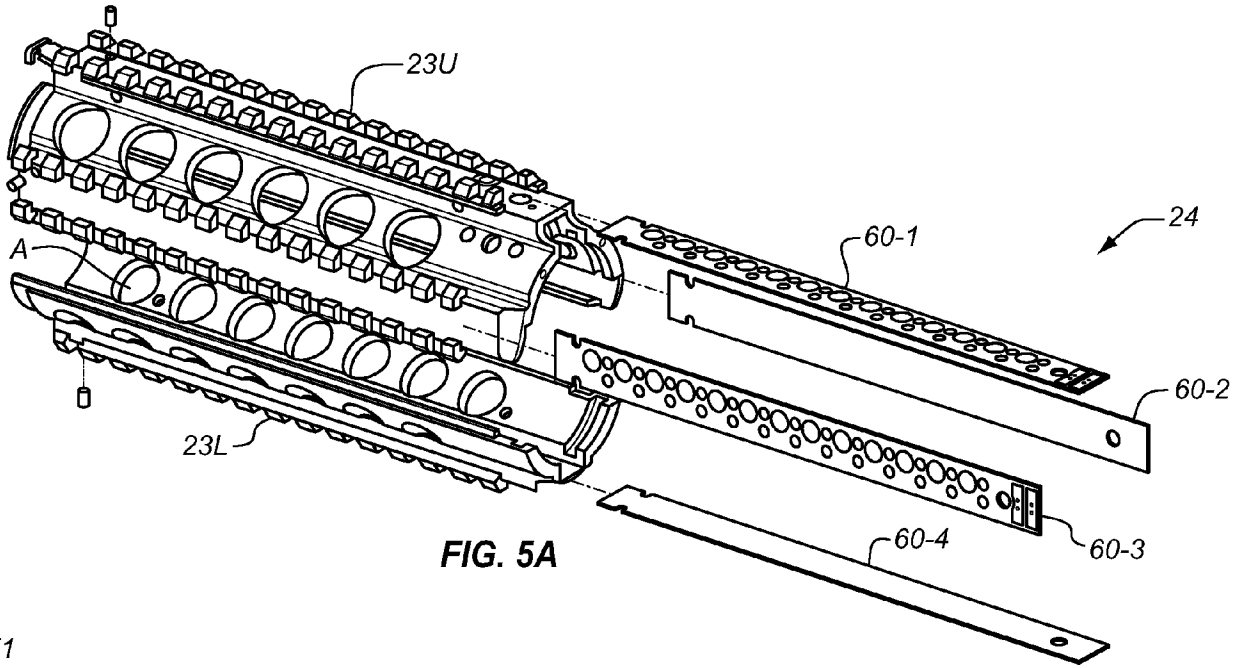
FIGS. 5A-5C are illustrations of the Handguard assembly, including the Powered Rail, of the Weapons Accessory Power Distribution System.
Figure 5B:
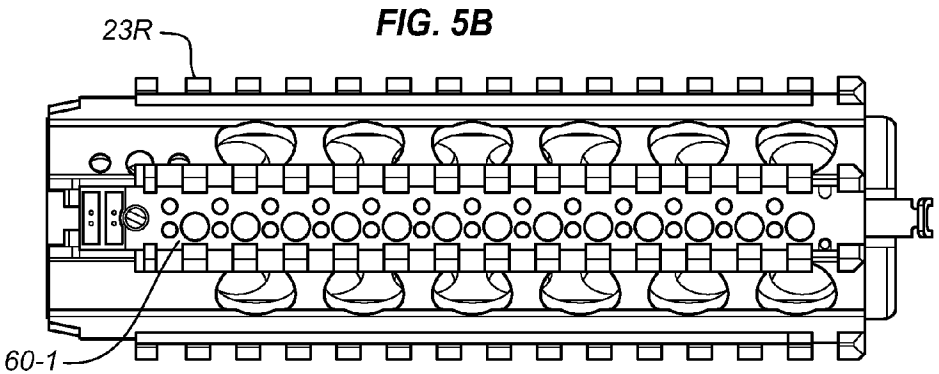
Figure 5C:
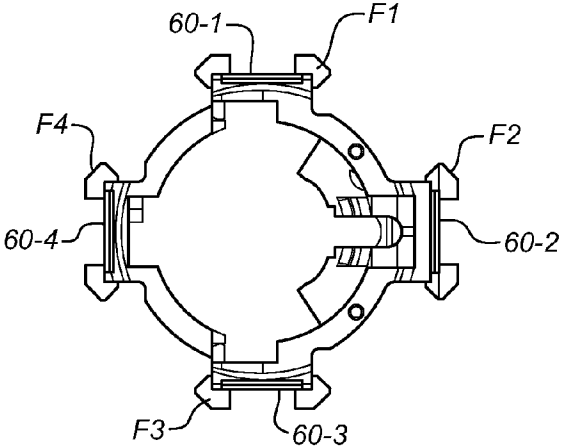

FIGS. 5A-5C are perspective exploded view, side view, and end view illustrations, respectively, of the Handguard 23 assembly, including the Powered Rail 24, of the Weapons Accessory Power Distribution System. The Powered Rail 24, as shown as an example, includes a series of ridges with a T-shaped cross-section interspersed with flat "locking slots". This version of the Handguard 23, therefore, can be viewed as an adaptation of the existing non-powered Picatinny Rail which involves milling slots along the length of the mechanical accessory attachment points 23R in the upper Handguard section (23U) and the lower Handguard section (23L) in order to install one or more power distribution Printed Circuit Boards 60-1 to 60-4, with FIG. 5C showing an end view of the slots formed in the various facets F1-F4 of the Handguard 23. As with the Picatinny Rail, Apertures A are provided along the length dimension L of the Handguard 23 to enable the barrel 103 of the weapon 2 to be cooled by air circulation from the ambient environment. Other Powered Rail configurations are possible, and this architecture is provided as an illustration of the concepts of the Weapons Accessory Power Distribution System.

One or more of the Powered Rail subassemblies (typically Printed Circuit Boards) 60-1 to 60-4 can be inserted into the respective slots formed in the Powered Rail 24 (on the corresponding facets F1-F4 of the Handguard 23) thereby to enable power-consuming accessories to be attached to the Handguard 23 of the weapon 2 via the Powered Rail 24 on any facet F1-F4 of the Handguard 23 and to be powered by the corresponding Printed Circuit Board 60-1 to 60-4 installed in the Powered Rail 24 on that facet.

Battery Pack

Figure 3B:
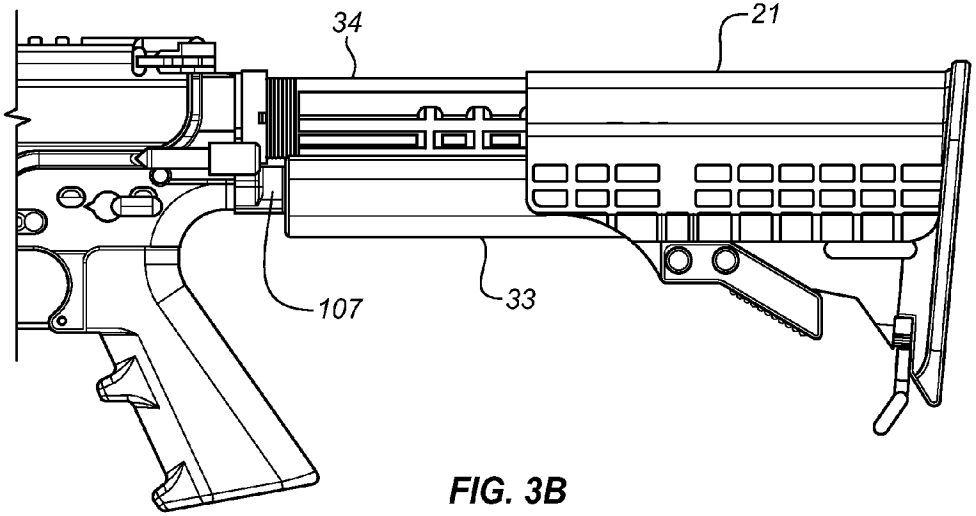
Figure 4A:
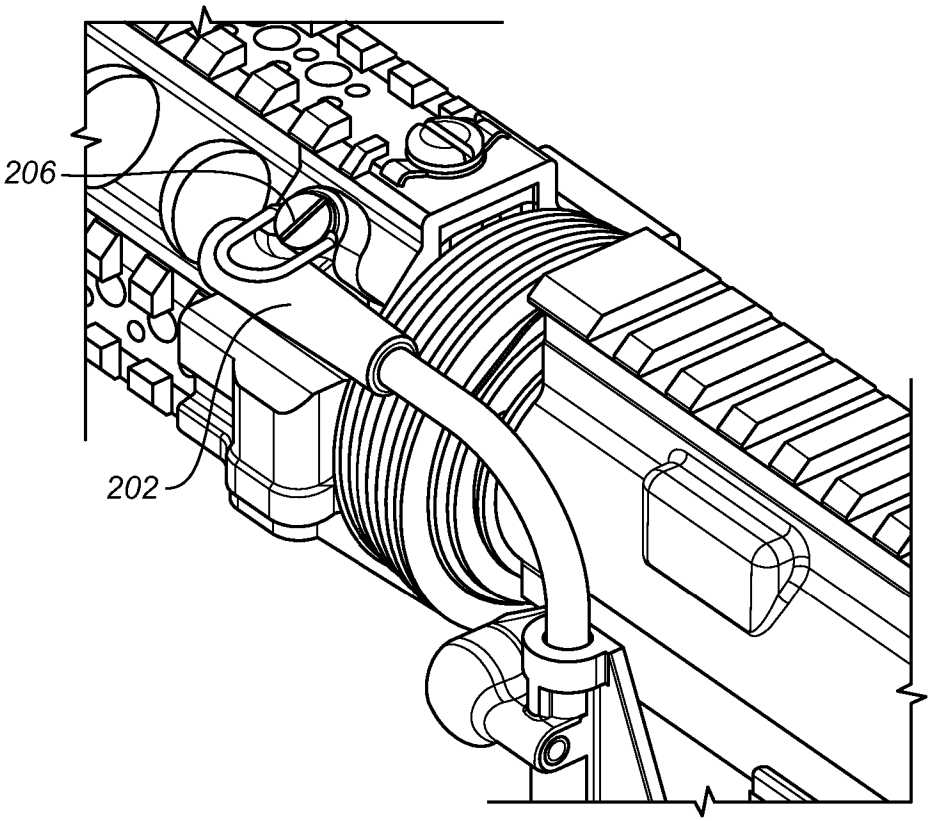
FIGS. 4A-4C are illustrations of the Power Distribution System which interconnects the Battery Pack to the Powered Rail in the Weapons Accessory Power Distribution System.
Figure 4B:
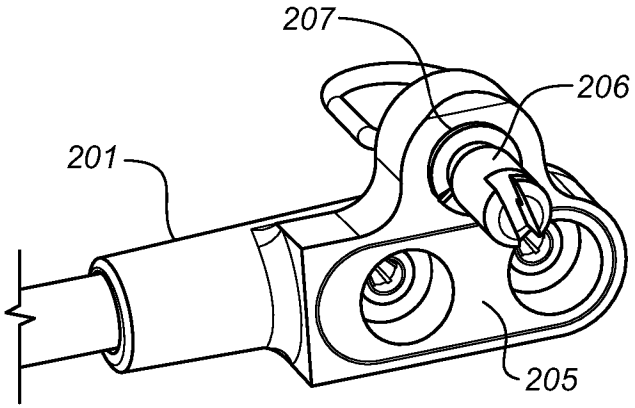
Figure 4C:
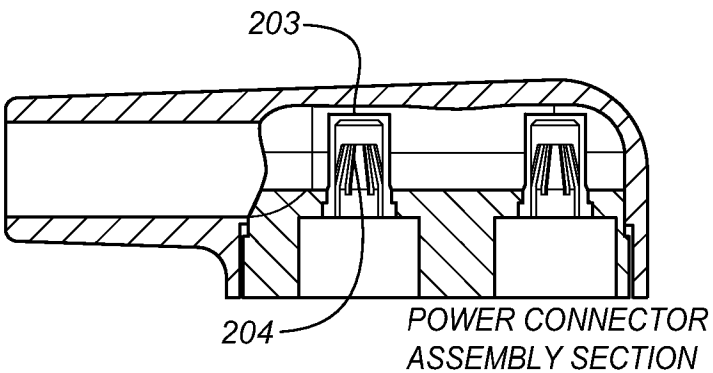

The Battery Pack can be implemented in a number of assemblies and mounted on various portions of the weapon (such as on the Powered Rail, or in a pistol grip, or in a remote power source, and the like) as described in the above-noted U.S. patent application Ser. No. 12/689,438 filed on Jan. 19, 2010 titled "Rifle Accessory Rail Communication And Power Transfer System-Battery Pack". For the purpose of this description, FIGS. 3A and 3B are illustrations of a typical Butt Stock 21 and Battery Pack 33 of the Weapons Accessory Power Distribution System. For example, a butt stock/recoil tube battery pack assembly includes an adjustable Butt Stock 21, a Cam Latch 32, and a removable Battery Pack 33. The Butt Stock 21 adds a compartment to the underside of the existing lower receiver extension (also termed "buffer tube" herein) assembly 34 which allows the Battery Pack 33 to be installed and withdrawn for removal through the rear of the rifle. The Battery Pack 33 mounts on the buffer tube assembly 34 independent of the Butt Stock 21 which telescopes along the rifle. The Butt Stock 21 is adjustable and can be extended in various multiple intermediate positions to provide an adjustable length of the firearm, as is well known in the art. By moving the mass of the battery rearward on the weapon, the time required to bring the weapon to point is reduced, as well as the time needed to "stop" the muzzle when the target is acquired.

Power Distribution System

The Power Distribution System 22 is shown in FIGS. 2A, 2B, and 4A-4C as a one-piece housing 201 and ruggedized power rail connector 202 where sealing integrity is maintained during exposure to adverse environmental conditions. The power rail connector 202 consists of a metallic shell body, contact pin receptacle 203, with a press fit multi-finger spring contact 204 assembled into the contact pin receptacle 203. The multi-finger spring contact 204 provides compliance to variations in the mating pin to ensure continuous current carrying capacity of the connection. The contact pin receptacle 203 includes a solder tail portion for soldering cable wires. The bottom panel insulator 205 mounts the contact pin receptacle 203 with the bottom part and fitted over the connector contact pin receptacle 203 and is sealed with a sealing compound. A fastener 206 and retaining ring 207 are used to secure the connector assembly into the rail pin contacts.

An electric wire is routed from the Battery Pack 33 in the Butt Stock 21 to the Powered Rail 24. The external wiring is housed inside a durable and impact resistant polymer shroud 108 that conforms to the lower receiver 102. The shroud is securely retained by a quick connect/disconnect pivot and takedown pin 111 as well as the bolt release roll pin 109 in the trigger/hammer pins 110. The shrouded power cable runs from the battery power connector 107 at the Butt Stock 21 to the Power Rail connector 202. This design provides an easy access for replacing or repairing the cable assembly and eliminates snag hazards or interferences with the rifle operation and requires no modifications to the rifle lower receiver 102 housing.

Powered Rail

The Powered Rail 24 is used to electrically interconnect a power source (Battery Pack 33) with the various accessories mounted on the Powered Rail 24, such that the Powered Rail 24 of the Handguard 23 provides the mechanical support for the accessory and the Powered Rail 24 also provides the electrical interconnection. In this example, the Powered Rail 24 is attached to and coextensive with the Handguard 23 sections, such that the mounting of a Power-Consuming Accessory on the Powered Rail 24 results in simultaneous mechanical and electrical interconnection.

Figure 6A:
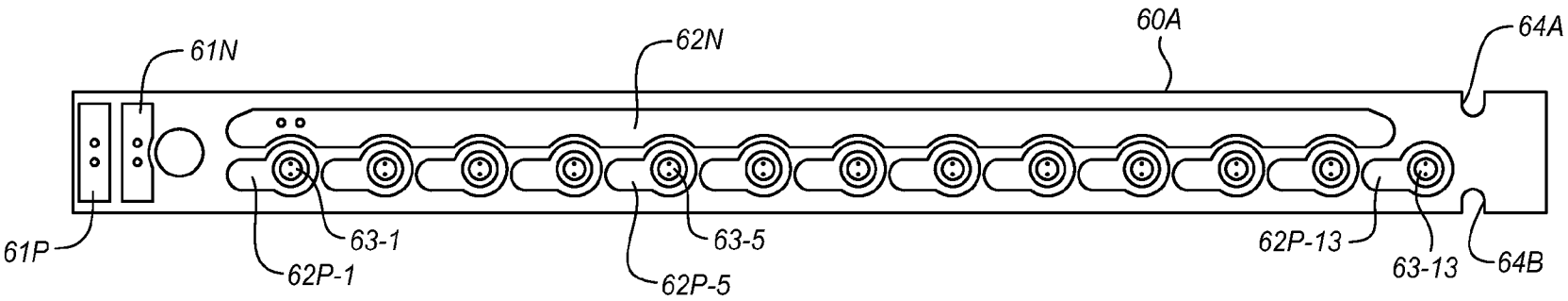
Figure 6B:
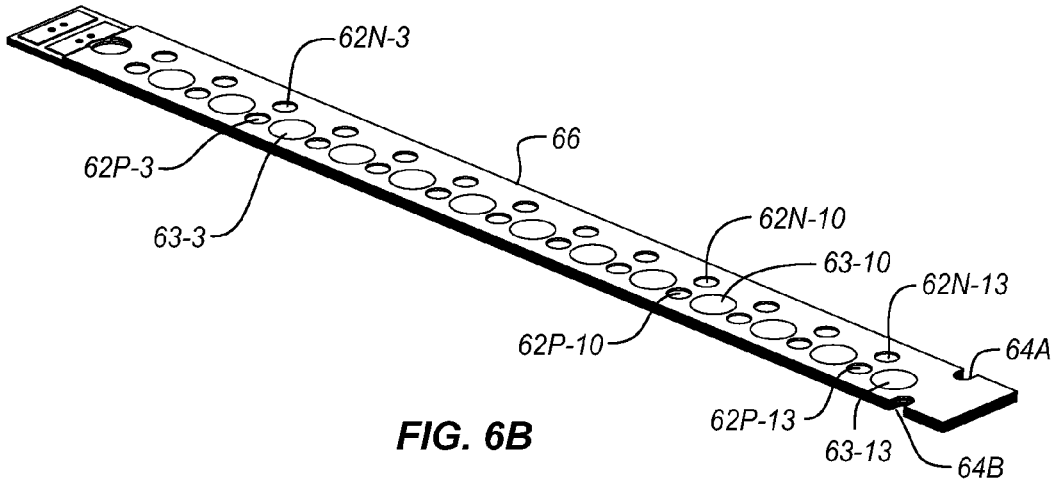
Figure 6C:
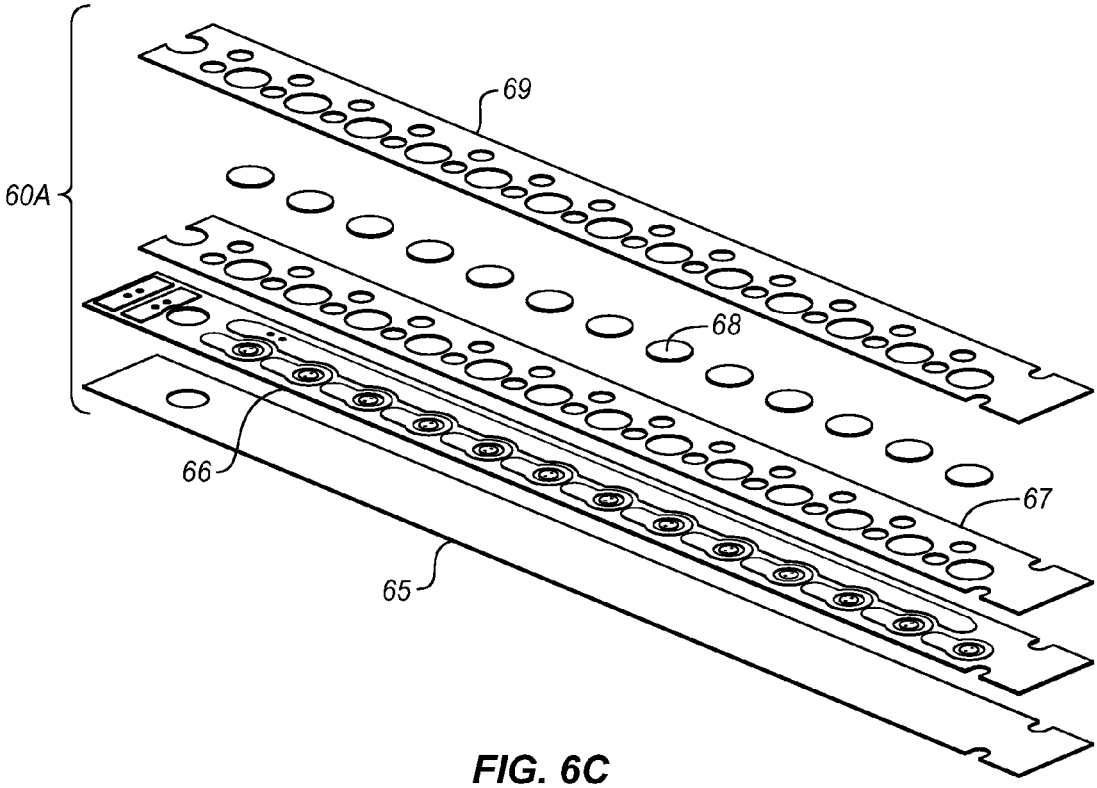
FIG. 6C is an exploded perspective view of the Powered Rail.
Figure 8A:
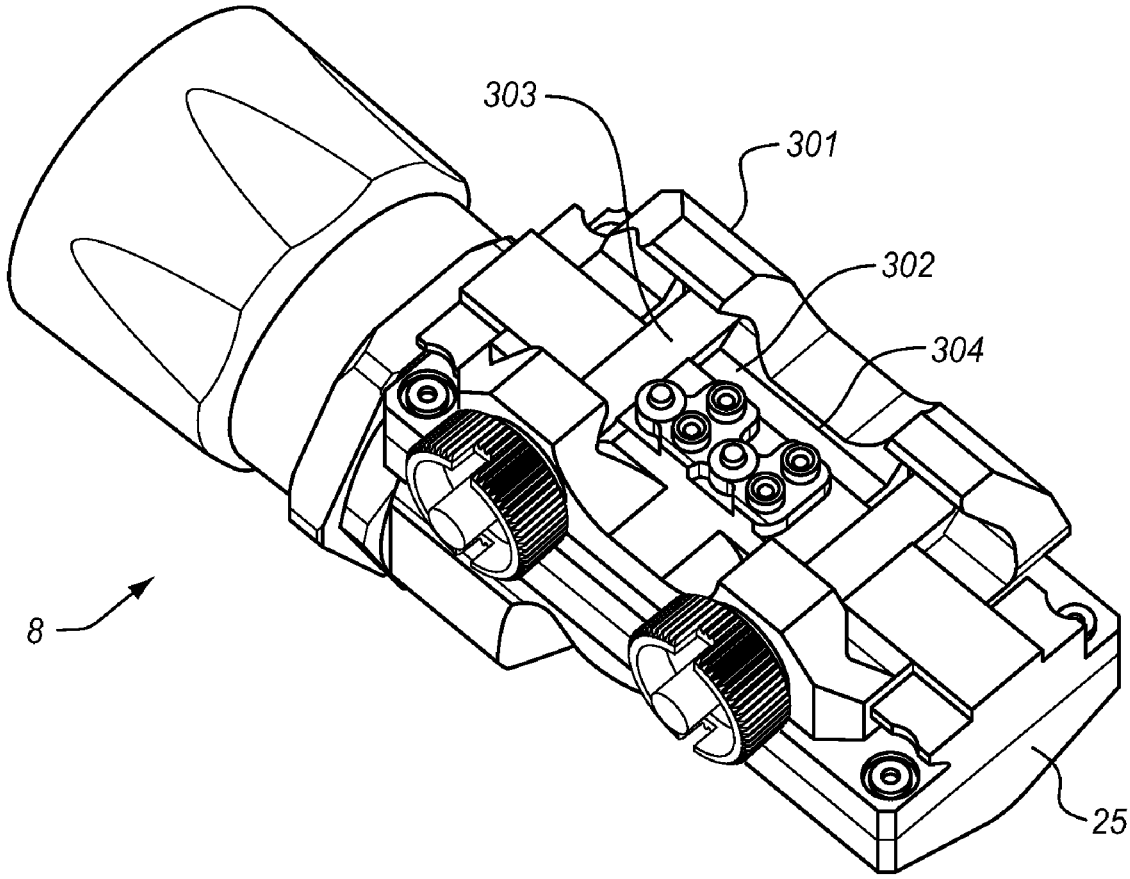
FIGS. 8A-8C are illustrations of the typical mechanical interconnection and electrical interconnection of a Power-Consuming Accessory to the Handguard and Powered Rail.
Figure 8C:
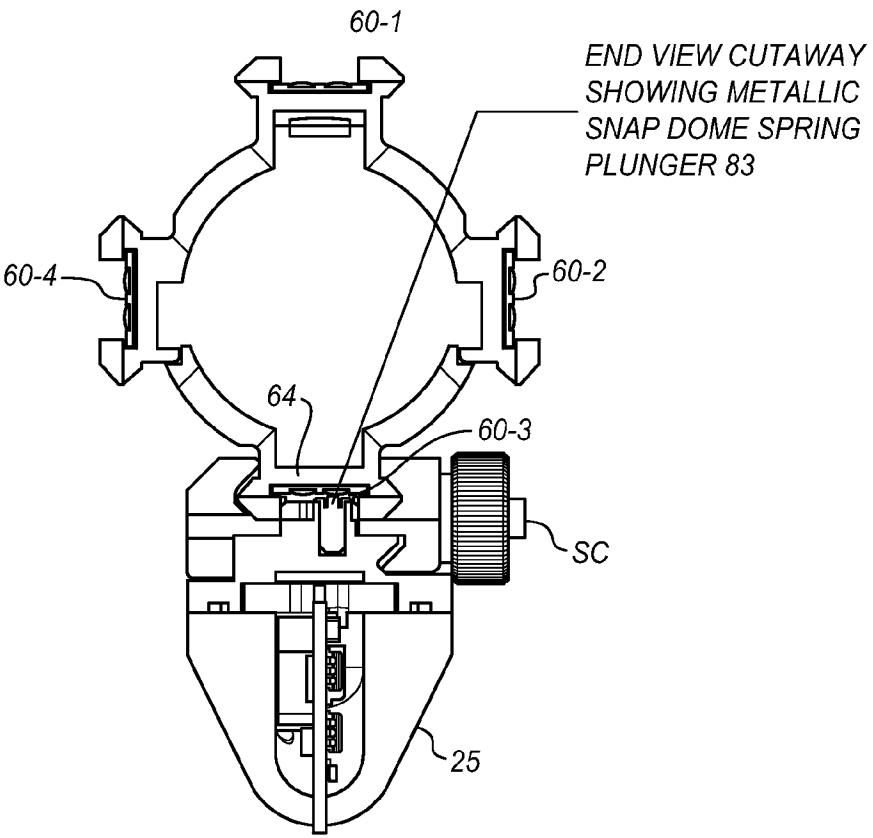
Figure 8B:
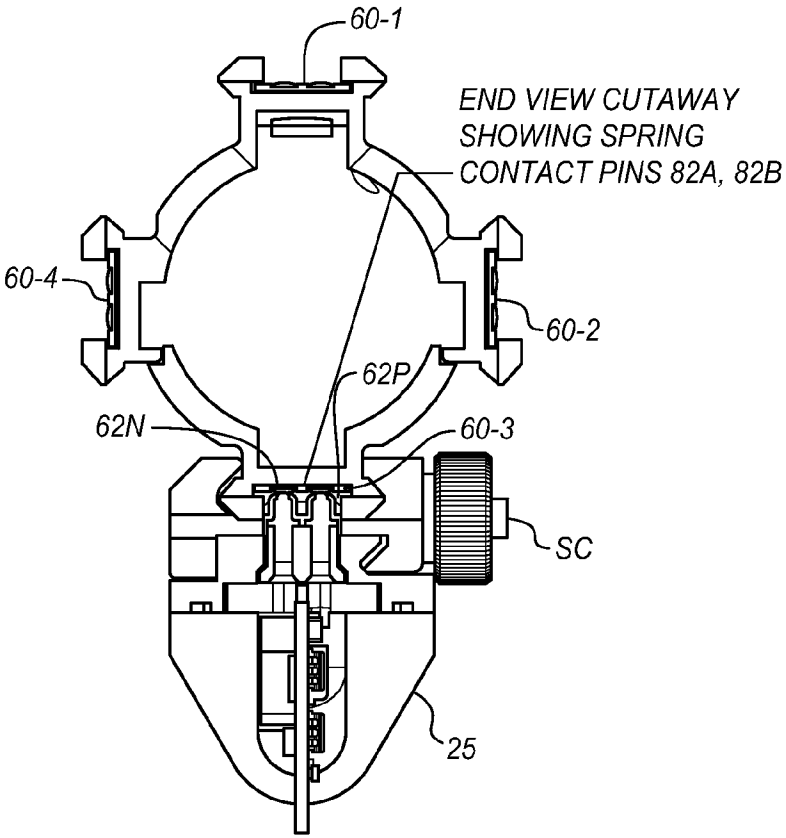

FIGS. 6A and 6B are top views of two versions of the Powered Rail 24; FIG. 6C is an exploded view of the Powered Rail 24; FIGS. 7A and 7B illustrate the details of the Powered Rail 24 electrical interconnection; and FIGS. 8A-8C are illustrations of the typical mechanical interconnection and electrical interconnection of a Power-Consuming Accessory to the Handguard 23 and Powered Rail 24.

As noted above, the Powered Rail 24 comprises one or more Printed Circuit Boards (60-1 to 60-4) which are mounted in the apertures formed in a successive plurality of locking slots on the Powered Rails 24 to carry power to power-consuming accessories which are mounted on the Powered Rail 24 at various locations. The Printed Circuit Boards (60-1 to 60-4) are soldered to electrically conductive busses 72, 74. In addition, a conductive pin connector 73 includes a terminal portion at one end which is pressed into the mating hole (not shown) in the interconnect electrical bus 72. Retaining clips 71 are manufactured from resilient metallic spring material, which are anchored on the upper rail connector 75 and a clamp hook feature of the retaining clip 71 is used to securely hold the lower rail connector 76 by engaging features 77 formed on the lower rail connector 76. FIG. 7B illustrates the retaining clips 71 and electrically conductive busses 72 typically encapsulated in an insulative protective coating 78. The connector is removable and can be easily mounted through the retaining clips 71 which provide positive retention and a means of securing the connector halves. Mated connector pairs have tab features which captivate the clips.

FIGS. 6A and 6B illustrate the architecture of the Printed Circuit Board where remote power is applied via the positive connector contact 61P and the negative connector contact 61N. As shown in FIG. 6A, the power is routed by the electrical traces on the Printed Circuit Board 66. The positive current from positive connector contact 61P is routed to the center of the Printed Circuit Board switch (for example, 63-5) where it is switched via operation of the switch 68 (shown in FIG. 6C) to contact 63P-5, while the negative current from the negative connector contact 61N is routed to the negative buss 62N or negative bus contact pads (for example, 62N-3). The example shown in these figures provided thirteen positions where a power-consuming accessory can be attached and contact the power contacts of the Powered Rail 24. In particular, on both FIGS. 6A and 6B, there are thirteen positive contacts 62P-1 to 62P-13 (only several of which are numbered on the figures to avoid clutter). In FIG. 6A, a continuous negative buss 62N is provided as the other power source connection. In FIG. 6B, the negative power source connections are provided by thirteen individual negative buss contact pads 62N-1 to 62N-13 (only several of which are numbered on the figures to avoid clutter). On the printed circuit board 60A, there are points of attachment, typically comprising notches 64A and 64B, which are used to secure the printed circuit board in place in the corresponding slot of the Powered Rail 24 via a pin clip arrangement.

Figure 10:
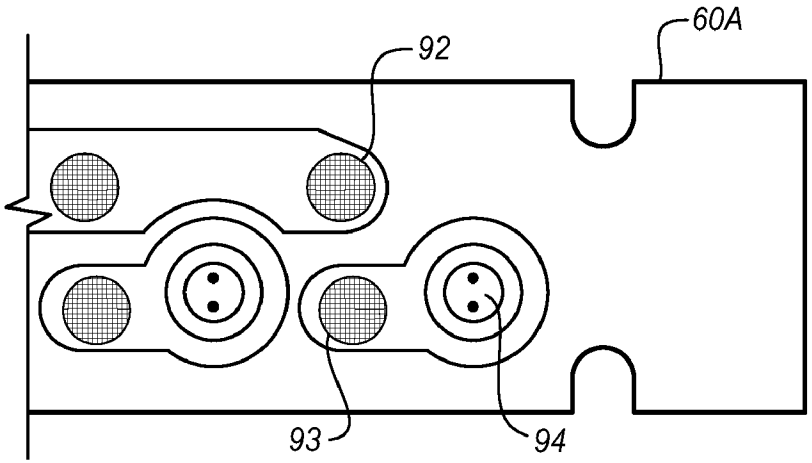
FIG. 10 is an illustration of a Low Reflectivity Contact soldered to a Printed Circuit Board.

The positive 62P-3, 62P-10, 62P-13 (for example) and negative 62N-3, 62N-10, 62N-13 contacts (on FIG. 6B) can be continuously powered, especially in the case where only one set of contacts is provided, or can be switch activated by metallic snap dome switches 63-3, 63-10, 63-13 which are placed over positive common 94 (as shown in FIG. 10) and are in electrical contact with the accessory positive switched contact 62P-3, 62P-10, 62P-13. The metallic snap dome switch has a pair of conductive contacts which are normally in the open mode; when the cover of the metallic snap dome switch is depressed via a projection on the exterior surface of the power-consuming accessory which is mounted on the Powered Rail 24 juxtaposed to the metallic snap dome switch, these contacts mate and provide an electrical connection between positive common 94 and a positive switched contact 62P as shown in FIG. 10. The metallic snap dome switch is a well-known component and consists of a curved metallic dome that spans two conductors (positive common 94 and a positive switched contact 62P (as shown in FIG. 10) such that when the dome is depressed, it snaps downward to electrically bridge the two conductors. The accessory positive switched contact 62P and the accessory common negative buss contact pad 62N are both implemented using the Low Reflectivity Contact described below.

FIG. 6C illustrates an exploded view of the power distribution Printed Circuit Board assembly where a non-conductive layer 65 prevents the metal weapon Rail from electrically shorting the power distribution Printed Circuit Board 66. Spacer layer 67 is a non-conductive element which holds the snap dome switches in place so they do not move laterally during assembly. Metallic snap dome switches 68 provide the electrical switching action to mounted rail accessories. Top cover layer 69 provides environmental protection to the Printed Circuit Board 66 and the metallic snap dome switches 68 when the aforementioned layers are assembled.

Powered Accessory Mounting

FIGS. 8A-8C are illustrations of the typical mechanical interconnection and electrical interconnection of a power-consuming accessory (such as flashlight 8) to the Handguard 23 and Powered Rail 24. The perspective view of FIG. 8A shows how the Powered Accessory Mounting 25 attaches the power-consuming accessory to the Powered Rail 24 and consists of a rail grabber 301, spring contacts 302, spring plungers 303, and face seals 304. The spring plungers 303 depress the snap-dome switches on the Powered Rail 24, the spring contacts 302 provide electrical contact with the fixed electrical bus contacts 62M and 62P-* on the Powered Rail 24 Printed Circuit Board assembly, and the face seals 304 provide environmental protection.

FIGS. 8B and 8C are cutaway end views of the interconnection of a power-consuming accessory to the Handguard 23 and Powered Rail 24. In particular, the power-consuming accessory and associated Powered Accessory Mounting ACC are mechanically attached to the Handguard 23 in well-known fashion (via screw clamp SC shown here). The Powered Accessory Mounting ACC includes a pair of spring contact pins 82A, 82B which contact corresponding Low Reflectivity Contacts 62N and 62P which are mounted on Printed Circuit Board 60-3. Similarly, the Powered Accessory Mounting ACC includes a spring plunger 83 which contacts corresponding metallic snap dome switch 64 which is mounted on Printed Circuit Board 60-3.

Characteristics of Electrical Contacts and Connectors

An ideal electrical connector has a low contact resistance and high insulation value. It is resistant to vibration, water, oil, and pressure. It is easily mated/unmated, unambiguously preserves the orientation of connected circuits, reliable, and carries one or multiple circuits. Desirable properties for a connector also include easy identification, compact size, rugged construction, durability (capable of many connect/disconnect cycles), rapid assembly, simple tooling, and low cost. No single electrical connector has all of the ideal properties. The proliferation of types of electrical connectors is a reflection of the differing importance placed on the design factors.

From a light reflectivity standpoint, the selection of low resistivity metals to construct the contact contradicts with the goal of achieving low light reflectivity. In particular, gold is highly conductive and makes an excellent choice for a contact, but has a high light reflectivity. If coatings are applied to a gold contact to reduce the light reflectivity, the resistivity of the contact is increased and the coatings quickly wear off in a hostile ambient environment where there are many connect/disconnect cycles. Mechanically modifying the surface of the gold to reduce the flat light reflecting plane presented to incoming visible light also reduces the conductivity of the contact and fails to achieve adequate reductions in light reflectivity reduction. Similar problems are encountered with attempts to alloy gold with other metals.

Therefore, existing methods of modifying highly conductive metal contacts to reduce light reflectivity are ineffective.

Characteristics of the Low Reflectivity Contact

Figure 9:
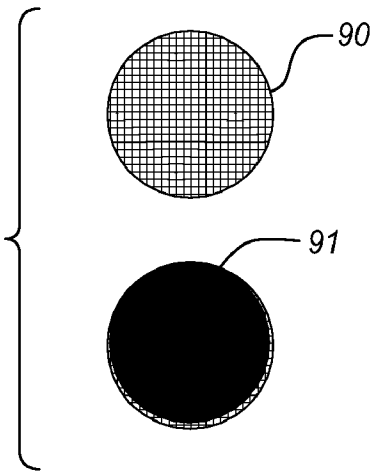
FIG. 9 is a schematic of loose mesh grid disks, plain side up and solder side up, which are used to implement the Low Reflectivity Contact.

FIG. 9 is a schematic of loose mesh contact disks, plain side 90 up and solder side 91 up, which are used to implement the Low Reflectivity Contact; and FIG. 10 is an illustration of a Low Reflectivity Contact 92 soldered to a Printed Circuit Board 93. The Low Reflectivity Contact 92 consists of one Contact of a Contact Pair and is manufactured from a suitable material, with one example being a 400 mesh, alloy 304 Stainless Steel which is woven with a 0.001" thick wire of cylindrical cross-section. The mesh is cut into the desired shape, such as a circle, and one side of the mesh is tinned with solder and soldered on to a Printed Circuit Board (PCB) which is designed to carry power from a power source to the electrical contacts. The other Contact of the Contact Pair consists of a spring loaded contact pin (or lever or any other mechanism to make mechanical contact with the Low Reflectivity Contact) to touch the mesh surface of the Low Reflectivity Contact to provide an electrical connection.

The selection of a wire mesh to implement the electrical contacts is dictated by the need to provide a low light reflectivity characteristic for the exposed electrical contacts. The need for low light reflectivity is important in certain applications, such as military weapons. In addition, the Low Reflectivity Contact provides a target of dimensions which enable the mating Contact of the Contact Pair to complete the circuit connection without the need for precise spatial three-dimensional alignments of the two Contacts of the Contact Pair.

Figure 11B:
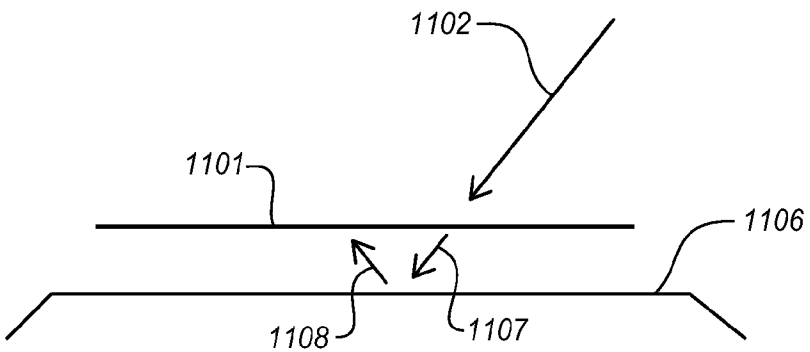
FIGS. 11A and 11B are illustrations of the light reflectivity geometry of the Low Reflectivity Contact.
Figure 11A:
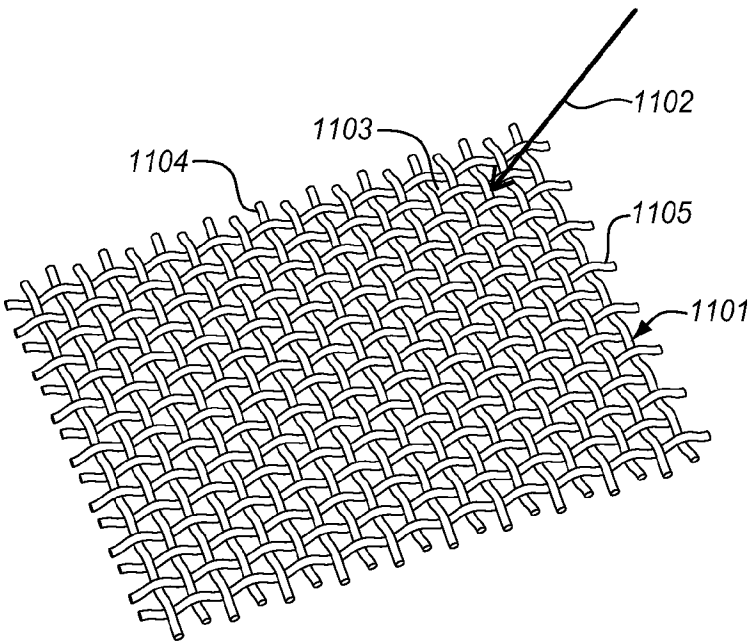

FIGS. 11A and 11B are illustrations of the light reflectivity geometry of the Low Reflectivity Contact. The Low Reflectivity Contact typically comprises a mesh grid 1101 formed of a matrix of electrical wires 1104 and 1105 which are interconnected to form a matrix with apertures 1103 formed in the surface thereof. Alternatively, the mesh grid 1101 can be formed of a sheet of electrically conductive material with apertures 1103 formed in the surface thereof. Incident visible light 1102 (as well as other wavelengths of light) is dispersed by the electric wires 1104, 1105; and only a small fraction of the incident visible light passes through the apertures 1103 of the mesh grid 1101 to the underlying surface 1106, which is typically a conductive pad on the surface of the Printed Circuit Board. The incident light 1107 that passes through the apertures 1103 is reflected 1108 off surface 1106 and strikes the bottom surface of the mesh grid 1101. Therefore, the only way the incident visible light is retransmitted back out of the Low Reflectivity Contacts is for the reflected beam 1108 to pass through an aperture 1103. Thus, by the proper selection of the size of the electric wires 1104, 1105, the density of the wires in the matrix, and the spacing between the mesh grid 1101 and the underlying surface 1106, the size of the apertures and the light reflection path can be managed to substantially eliminate the reflection of visible light off the Low Reflectivity Contact.

Thus, the present Low Reflectivity Contact minimizes light reflectivity by the use of a conductive mesh grid which is attached to an underlying conductive surface. The conductive mesh grid comprises a substantially planar structure, typically a matrix of interconnected wires with apertures formed between the intersecting wires, and is used to form the outer surface of the electrical contact. The weave density, weave geometry, and wire diameter of the conductive mesh grid maximizes the attenuation of reflected light in the visible spectrum, yet maintains high electrical conductivity and a lack of sensitivity to contamination via the choice of materials used to implement the Low Reflectivity Contact.

There has been described a Weapons Accessory Power Distribution System. It should be understood that the particular embodiments shown in the drawings and described within this specification are for purposes of example and should not be construed to limit the invention, which is described in the claims below. Further, it is evident that those skilled in the art may make numerous uses and modifications of the specific embodiment described without departing from the inventive concepts. Equivalent structures and processes may be substituted for the various structures and processes described; the subprocesses of the inventive method may, in some instances, be performed in a different order; or a variety of different materials and elements may be used. Consequently, the invention is to be construed as embracing each and every novel feature and novel combination of features present in and/or possessed by the apparatus and methods described.

What is claimed as new and desired to be protected by Letters Patent of the United States is:

1. A Weapons Accessory Power Distribution System for use with a handguard, which extends along at least a portion of a length of a barrel of a weapon and at least partially encircles said barrel, for providing a supply of electrical power for use by at least one power-consuming accessory operatively associated with said weapon, said Weapons Power Distribution System comprising:

a power source; and at least one powered rail, extending along at least a portion of a length of said handguard and electrically connected to said power source, wherein said powered rail comprises:

at least two sections, a first section located on a top side of said handguard and a second section located on a bottom side of said handguard;

a plurality of mechanical features formed on the outer surface of said powered rail in a parallel, spaced-apart relationship for mechanically positioning a power-consuming accessory, an aperture formed in a plurality of sequential ones of said mechanical features, and an insulative backplane, mounted in said aperture, and which has formed thereon a first electrical contact and a second electrical contact positioned between at least two of said mechanical features for providing a first and a second electrical connection to said power source, respectively; and two terminal pads electrically connected to respective ones of said first and second electrical contacts;

a power distribution system for electrically interconnecting said power source and said at least one powered rail, comprising:

two electrically conductive busses electrically interconnected with said two terminal pads of said insulative backplane formed into two mating sections comprising an upper rail connector and a lower rail connector, to encircle said handguard and contact said first and said second sections of said powered rail, respectively, and two electrical conductors electrically connected at a first end to said two electrically conductive busses, respectively, and at a second end to said power source, two retaining clips manufactured from a resilient spring material, anchored on the upper rail connector, two clamp hooks anchored on the lower rail connector, and wherein said two retaining clips and said two clamp hooks are engageable to securely hold the lower rail connector in mechanical and electrical contact with said second section of said powered rail;

wherein mechanical mounting of a power-consuming accessory between said two mechanical features electrically connects said power-consuming accessory to said first and said second electrical contacts.

2. The Weapons Accessory Power Distribution System of claim 1 wherein said insulative backplane further comprises:

an electrical switch formed in said aperture, wherein a first contact of said electrical switch is electrically connected to said power source, and a second contact of said electrical switch is electrically connected to said first electrical contact.

3. The Weapons Accessory Power Distribution System of claim 2 wherein mounting a power-consuming accessory on said powered rail simultaneously mechanically secures said power-consuming accessory to said powered rail and electrically interconnects two electrical contacts on said power-consuming accessory to said first and said second electrical contacts of said insulative backplane and simultaneously contacts and operates said electrical switch to electrically connect said first electrical contact of said insulative backplane.

4. The Weapons Accessory Power Distribution System of claim 1 wherein said power source comprises:

a battery mounted inside of a butt stock of said weapon.

5. The Weapons Accessory Power Distribution System of claim 4 wherein said power source further comprises:

a receiver extension attached at a distal end of said weapon and containing an aperture formed along the length thereof;

an adjustable butt stock containing an aperture formed along the length thereof for slideable attachment to said receiver extension for positioning said butt stock at one of a plurality of predetermined positions on said receiver extension; and wherein said battery is electrically connected to said powered rail for providing electrical power to said at least one power-consuming accessory, and mechanically seated in said aperture formed in said receiver extension.

6. The Weapons Accessory Power Distribution System of claim 1 wherein said first end of said two electrical conductors comprises:

a metallic body; and two contact pin receptacles, each with a press fit multi-finger spring contact assembled into a machined shell body.

7. The Weapons Accessory Power Distribution System of claim 6 wherein said power distribution system further comprises:

two conductive pin connectors electrically connected to respective ones of said two electrically conductive busses and configured to interconnect with corresponding ones of said two contact pin receptacles.

8. The Weapons Accessory Power Distribution System of claim 1 wherein said power distribution system further comprises:

two spring contacts for electrically connecting the electrically conductive busses of said lower rail connector to said two terminal pads of said section of said insulative backplane.

9. The Weapons Accessory Power Distribution System of claim 1 wherein said power distribution system further comprises:

two spring contacts for electrically connecting the electrically conductive busses of said lower rail connector to said upper rail connector.

10. A Weapons Accessory Power Distribution System for providing a supply of electrical power for use by at least one power-consuming accessory operatively associated with a weapon, said Weapons Power Distribution System comprising:

at least one powered rail, which is structured to extend along at least a portion of a length of a barrel of a weapon comprises at least two sections, a first section located on a top side of said barrel and a second section located on a bottom side of said barrel;

a power source;

a power distribution system for electrically connecting said power source to said at least one powered rail, comprising:

two electrically conductive busses electrically interconnected with said two terminal pads of said insulative backplane formed into two mating sections comprising an upper rail connector and a lower rail connector, to encircle said barrel and contact said first and said second sections of said at least one powered rail, respectively, and two electrical conductors electrically connected at a first end to said two electrically conductive busses, respectively, and at a second end to said power source, two retaining clips manufactured from a resilient spring material, anchored on the upper rail connector, two clamp hooks anchored on the lower rail connector, and wherein said two retaining clips and said two clamp hooks are engageable to securely hold the lower rail connector in mechanical and electrical contact with said second section of said at least one powered rail; and wherein said at least one powered rail comprises:

a plurality of mechanical features formed on the outer surface of said at least one powered rail in a parallel, spaced-apart relationship for mechanically positioning said at least one power-consuming accessory, an aperture formed in a plurality of sequential ones of said mechanical features, an insulative backplane, mounted in said aperture, and which has formed thereon a first electrical contact and a second electrical contact positioned between two of said mechanical features for providing a first and a second electrical connection to said power source, respectively wherein said insulative backplane further comprises two terminal pads which are electrically connected to said first electrical contact and said second electrical contact; and wherein mechanical mounting of a power-consuming accessory between said two mechanical features electrically connects said power-consuming accessory to said first and said second electrical contacts.

11. The Weapons Accessory Power Distribution System of claim 10 wherein said first end of said two electrical conductors comprises:

a metallic body; and two contact pin receptacles, each with a press fit multi-finger spring contact assembled into a machined shell body.

12. The Weapons Accessory Power Distribution System of claim 11 wherein said power distribution system further comprises:

two conductive pin connectors electrically connected to respective ones of said two electrically conductive busses and configured to interconnect with corresponding ones of said two contact pin receptacles.

13. The Weapons Accessory Power Distribution System of claim 10 wherein said power distribution system further comprises:

two spring contacts for electrically connecting the electrically conductive busses of said lower rail connector to said two terminal pads of said insulative backplane of said at least one powered rail.

14. The Weapons Accessory Power Distribution System of claim 10 wherein said power distribution system further comprises:

two spring contacts for electrically connecting the electrically conductive busses of said lower rail connector to said upper rail connector.

15. The Weapons Accessory Power Distribution System of claim 10 wherein said insulative backplane further comprises:

an electrical switch formed in said aperture, wherein a first contact of said electrical switch is electrically connected to said power source, and a second contact of said electrical switch is electrically connected to said first electrical contact.

16. The Weapons Accessory Power Distribution System of claim 15 wherein mounting a power-consuming accessory on said at least one powered rail simultaneously mechanically secures said power-consuming accessory to said at least one powered rail and electrically interconnects two electrical contacts on said power-consuming accessory to said first and said second electrical contacts of said insulative backplane, and simultaneously contacts and operates said electrical switch to electrically connect said first electrical contact of said insulative backplane.

17. The Weapons Accessory Power Distribution System of claim 10 wherein said power source comprises:

a battery mounted inside of a butt stock of said weapon.

18. The Weapons Accessory Power Distribution System of claim 17 wherein said power source further comprises:

a receiver extension attached at a distal end of said weapon and containing an aperture formed along the length thereof;

an adjustable butt stock containing an aperture formed along the length thereof for slideable attachment to said receiver extension for positioning said butt stock at one of a plurality of predetermined positions on said receiver extension; and wherein said battery is electrically connected to said at least one powered rail for providing electrical power to said at least one power-consuming accessory, and mechanically seated in said aperture formed in said receiver extension.

19. The Weapons Accessory Power Distribution System of claim 10, further comprising:

wherein said at least one powered rail is juxtaposed to at least one of a top, bottom, and side of said barrel of said weapon.

* * * * *